US006449885B1

(12) United States Patent
Schulle

(10) Patent No.: US 6,449,885 B1
(45) Date of Patent: Sep. 17, 2002

(54) ADJUSTABLE TENSION FRAME

(76) Inventor: Gayion Schulle, P. O. Box 161446, Austin, TX (US) 78746

( * ) Notice: Subject to any disclaimer, the term of this patent is extended or adjusted under 35 U.S.C. 154(b) by 0 days.

(21) Appl. No.: 09/893,082

(22) Filed: Jun. 27, 2001

(51) Int. Cl.[7] ..... D06C 03/08
(52) U.S. Cl. ..... 38/102.21
(58) Field of Search ..... 38/102, 102.21, 38/102.4, 102.8; 160/371, 372, 374.1, 378

(56) References Cited

U.S. PATENT DOCUMENTS

| | | | | | |
|---|---|---|---|---|---|
| 335,762 | A | | 2/1886 | Levinson | |
| 378,914 | A | * | 3/1888 | Arbogast | 38/102.21 |
| 566,049 | A | | 8/1896 | Wolford | |
| 606,915 | A | * | 7/1898 | Butler | 38/102.21 |
| 940,070 | A | * | 11/1909 | Russell | 38/102.21 |
| 1,092,348 | A | * | 4/1914 | Fridlund | 38/102.21 |
| 1,223,015 | A | | 4/1917 | Woodley | |
| 1,269,751 | A | | 6/1918 | Shelton | |
| 2,569,337 | A | * | 9/1951 | Rice | 38/102.21 |
| 3,553,862 | A | | 1/1971 | Hamu | |
| 3,785,972 | A | | 1/1974 | Meyer et al. | |
| 4,471,542 | A | | 9/1984 | Umbenhauer | |
| 4,944,105 | A | | 7/1990 | Schulle | |
| D318,756 | S | | 8/1991 | Schulle | |
| 5,046,545 | A | | 9/1991 | Loomis et al. | |
| 5,255,455 | A | | 10/1993 | Hopper | |
| 5,347,732 | A | | 9/1994 | Padawer | |
| 5,351,424 | A | | 10/1994 | Schulle | |
| 5,906,062 | A | | 5/1999 | Kuhn | |

* cited by examiner

*Primary Examiner*—Ismael Izaguirre
(74) *Attorney, Agent, or Firm*—Johnson & Associates

(57) ABSTRACT

A method and apparatus is provided for easily and precisely adjusting the tension of fabric on a frame. A side member includes an adjustment member that is movable relative to the side member. The tension of the fabric is adjusted by adjusting the position of the adjustment member. The side member may also be provided in various lengths depending on the desires of a user.

31 Claims, 3 Drawing Sheets

ADJUSTABLE TENSION FRAME

FIELD OF THE INVENTION

This invention relates to frames for stretching fabric. In particular, this invention is drawn to an adjustable tension frame.

BACKGROUND OF THE INVENTION

It is well known to provide a frame for supporting a sheet of cloth fabric for various purposes. For example, the cloth fabric could be used for the background or base medium for needlework. In needlework, the general objective of the frame is to hold the fabric in a flat position such that both sides of the fabric are available, permitting a needle to be alternately inserted from opposite sides.

Examples of typical prior art frames are described and shown in commonly-owned U.S. Pat. Nos. 4,944,105, Des. 318,756, and 5,351,424, which are incorporated by reference herein. In addition, below is a description of the prior art. A needlework frame such as those described in the references listed above is particularly advantageous in that it provides generally parallel side members and cylindrical top and bottom members, forming a rectangular frame, with pieces of fabric permanently attached to the top and bottom members to which the needlework fabric can be temporarily stitched. The top and bottom members can be loosened and rotated to roll part of the needlework fabric onto one or both of these members, permitting the needlework fabric to be scrolled from the top to the bottom, for example, as the work progresses.

FIG. 1 is a diagram of a typical prior art scroll framed designed for holding needlework fabric. FIG. 1 shows a scroll frame and base with the needlework omitted for clarity. The frame, indicated generally at 10, includes parallel side members 12 and 13 which are interconnected by upper and lower members 15 and 16, respectively. Members 15 and 16 are provided with long, narrow pieces of coarse cloth 18 to which the upper and lower edges of the needlework fabric can be basted to hold the cloth between the upper and lower members. Normally, the needlework fabric will be longer or taller than the distance between members 15 and 16, in which case a portion of the fabric can be rolled onto one or both of the members 15 and/or 16. Members 15 and 16 are provided with threaded bolts protruding from the ends thereof that pass through holes formed in side members 12 and 13. The threaded bolts are secured by wing nuts 20.

The scroll frame is held on support arms 22 and 23 by carriage bolts 25 and wing nuts 26. The bolts 25 pass through spacer blocks 24 and the upper ends of the support arms 22 and 23. The lower ends of the support arms 22 and 23 are attached to support blocks 28 and 29, again by carriage bolts and wing nuts. Support blocks 28 and 29 are fixedly attached to slider plates 30 and 31 which form part of the base structure along with blocks 28 and 29 and support arms 22 and 23.

A generally H-shaped structure indicated generally at 35 includes front and rear elongated base members 36 and 37 and a central member 39 which extends between members 36 and 37 and is fixedly attached thereto. Central member 39 holds members 36 and 37 in a generally parallel relationship and extends between those members at a location intermediate the ends thereof to form the H-shaped frame structure. Member 39 is dimensioned so that slider plates 30 and 31 can fit between the inwardly facing parallel edges of members 36 and 37. Track members are attached to members 36 and 37 and are arranged to slidingly engage plates 30 and 31 so that those plates can be slidably moved relative to the H-shaped structure.

One problem with a scroll frame such as that shown in FIG. 1 is that to tighten the needlework fabric installed on the scroll frame, a user must manually twist the upper or lower members 15 or 16 and then tighten the wing nuts 20. First, it can be difficult to get the fabric as tight as desired. Second, for a user with weak or sore wrists, it can be difficult to twist the members 15 or 16.

FIG. 2 is a partial view of a prior art side member having a threaded yoke for receiving a hexagonal bar. FIG. 2 shows the end of a side member 40 with a concentric hole 42 drilled through the end of the side member 40. A threaded yoke 44 is inserted into the hole 42 with a threaded washer 46 threaded onto the yoke 44. A hexagonal bar 48 can then be inserted into the open end of the yoke 44. Note that the bar 48 is hexagonal so that it will not rotate within the open end of the yoke 44. By turning the threaded washer 46, the yoke 44 can be pressed outward from the hole 42, tightening fabric wound around the bar 48. The side member shown in FIG. 2 has several disadvantages. First, as mentioned, the bar 48 must be shaped so as to not turn within the yoke 44. Second, without the tension of fabric connected to the bar 48, there is nothing to hold the bar 48 within the yoke 44. Third, in order to turn the bar 48 to coarsely adjust the tension of fabric, the bar 48 must be lifted out of the yoke 44. Then, when the bar 48 is inserted into the yoke 44, the fabric will be loose again, until it is tightened by the treaded washer 46. This procedure makes adjusting the tension of the fabric difficult and touchy.

SUMMARY OF THE INVENTION

An apparatus of the invention is provided for an adjustable side member for a needlework frame including a side member having first and second ends, wherein the first end of the side member is adapted to be coupled to a first dowel; a movable adjustment member positioned near the second end, the movable adjustment member being adapted to be coupled to a second dowel; and an adjustment mechanism coupled to the side member and to the movable adjustment member for adjusting the position of the movable adjustment member relative to the side member in order to adjust the distance between the first and second dowels.

One embodiment includes an adjustable needlework frame comprising: first and second side members disposed generally parallel to each other; a first adjustment member slideably disposed within an elongated opening formed in the first side member perpendicular to the length of the first side member; a second adjustment member slideably disposed within an elongated opening formed in the second side member perpendicular to the length of the second side member; a lower member coupled between the first and second side member; and an upper member coupled between the first and second adjustment members forming a substantially rectangular frame that is adjustable by moving the first and second adjustment members back and forth within the elongated openings.

Another embodiment of the invention provides a method of 15. A method of maintaining a desired tension on fabric held by a frame comprising the steps of: providing first and second side members; providing a first adjustment member disposed with an opening formed in the first side member; providing a second adjustment member disposed with an opening formed in the second side member; providing a first dowel coupled to the first and second side members; providing a second dowel coupled to the adjustment members and disposed at least partially within the openings formed in the first and second side members; attaching a piece of fabric to the first and second dowels; and adjusting the tension of the fabric by moving the first and second adjustment members relative to the first and second side members.

Other objects, features, and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

The invention described below provides an adjustable tension frame for stretching fabric or the like. In one example, the invention is used as an adjustable tension scroll frame for needlework. The invention may be used for other applications is well, for example for a canvas frame for artwork. Briefly, the present invention provides an adjustment mechanism which allows a user to easily and precisely adjust the tension on a stretched piece of fabric with a minimum of effort.

Figure 3:
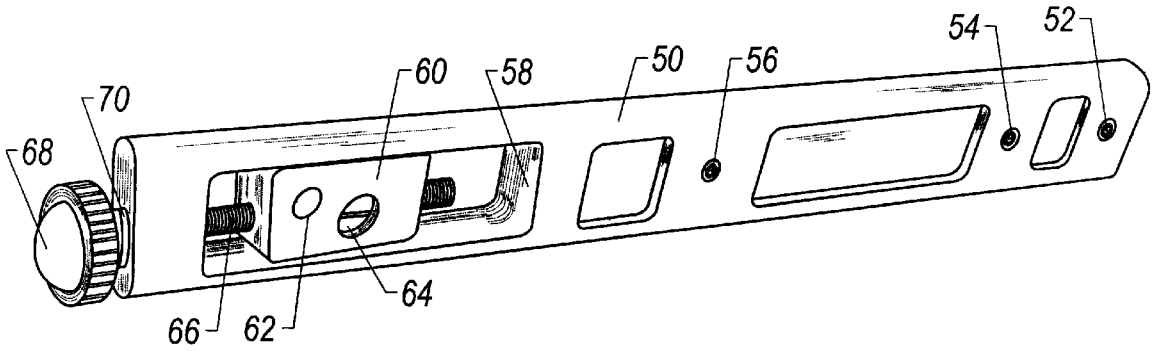
FIG. 3 is an isometric diagram of a side member of the present invention.

FIG. 3 is an isometric diagram of a side member of the present invention. A pair of side members such as that shown in FIG. 3 may be used with a conventional scroll frame such as described below. FIG. 3 shows a side member 50 having first and second ends. Like the side members of the prior art described above, the side member 50 is designed to hold upper and lower members which together form a scroll frame for holding a piece of fabric. The side member 50 includes a hole 52 adapted to receive the end of a lower member (described below). The side member 50 also includes an alternate hole 54 which may also be used to receive the end of a lower member. A hole 56 is used for to attached the side member 50 to a support arm.

An elongated opening 58 is formed in the side member 50 proximate the end of the side member 50 and is oriented perpendicular to the length of the side member 50. In the example shown in FIG. 3, the opening 58 is generally rectangular in shape, although other designs are possible. For example, the opening 58 could be comprised of other shapes, or could take the form of a notch formed in the side member 50. A movable adjustment member 60 is slidably disposed within the opening 58 such that it is allowed to slide back and forth within the opening 58. In the example shown, the adjustment member is comprised of a block, although it may take on many shapes or forms. The adjustment member 60 includes a hole 62 which is similar to the hole 52 for receiving an upper member. Coupled to the adjustment member 60 is a threaded fastener 64. An adjustment screw 66 extends through the adjustment member 60 and is threaded into the threaded fastener 64. The adjustment screw 66 extends through the and of the side member 50 and terminates at a knob 68. One or more washers 70 may be disposed between the knob 68 and the side member 50. When the knob 68 is rotated, the adjustment member 60 is forced to slide within the opening 58 in a direction dependent upon the direction that the knob 68 is turned. For example, if the knob 68 is turned in one direction, the adjustment member 60 is drawn toward the end of the side member 50, and away from the hole 52. Similarly, if the knob 68 is turned in the opposite direction, the adjustment member 60 is allowed to move in the opposite direction.

Figure 1:
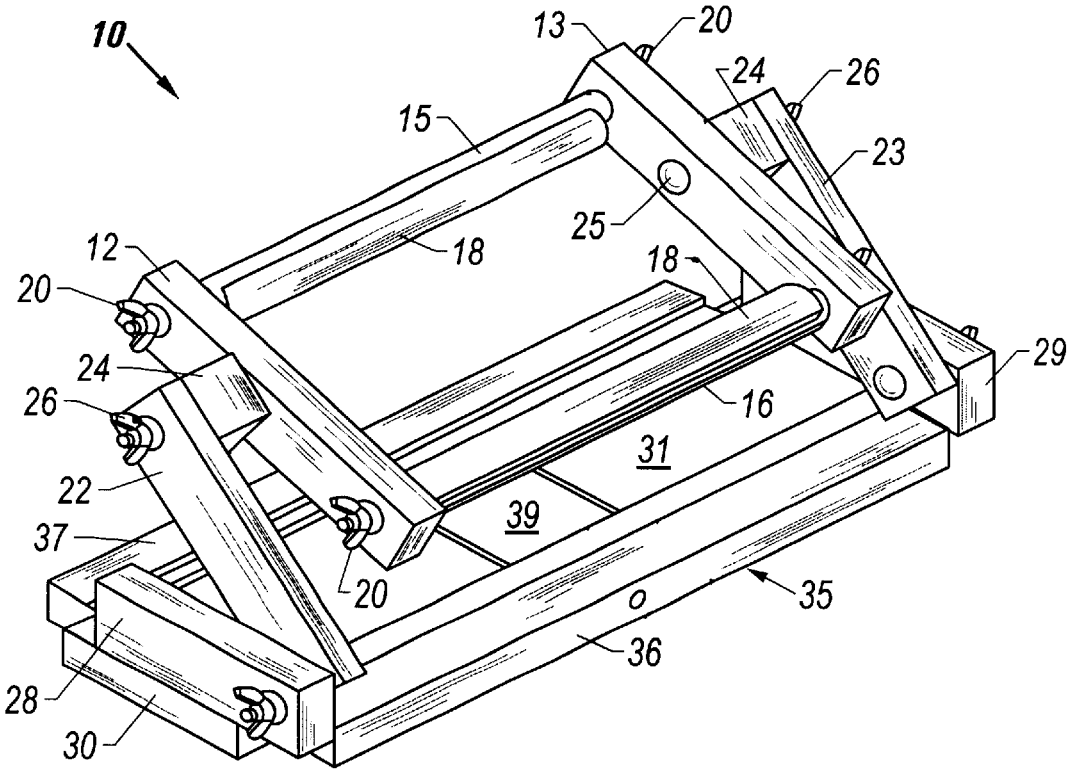
FIG. 1 (Prior Art)
FIG. 1 is a diagram of a typical prior art scroll framed designed for holding needlework fabric.
Figure 2:
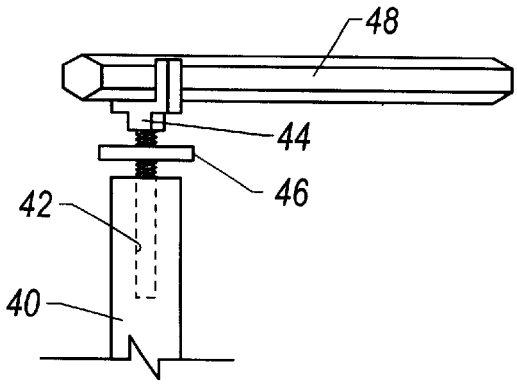
FIG. 2 (Prior Art)
FIG. 2 is a partial view of a prior art side member having a threaded yoke for receiving a hexagonal bar.
Figure 4:
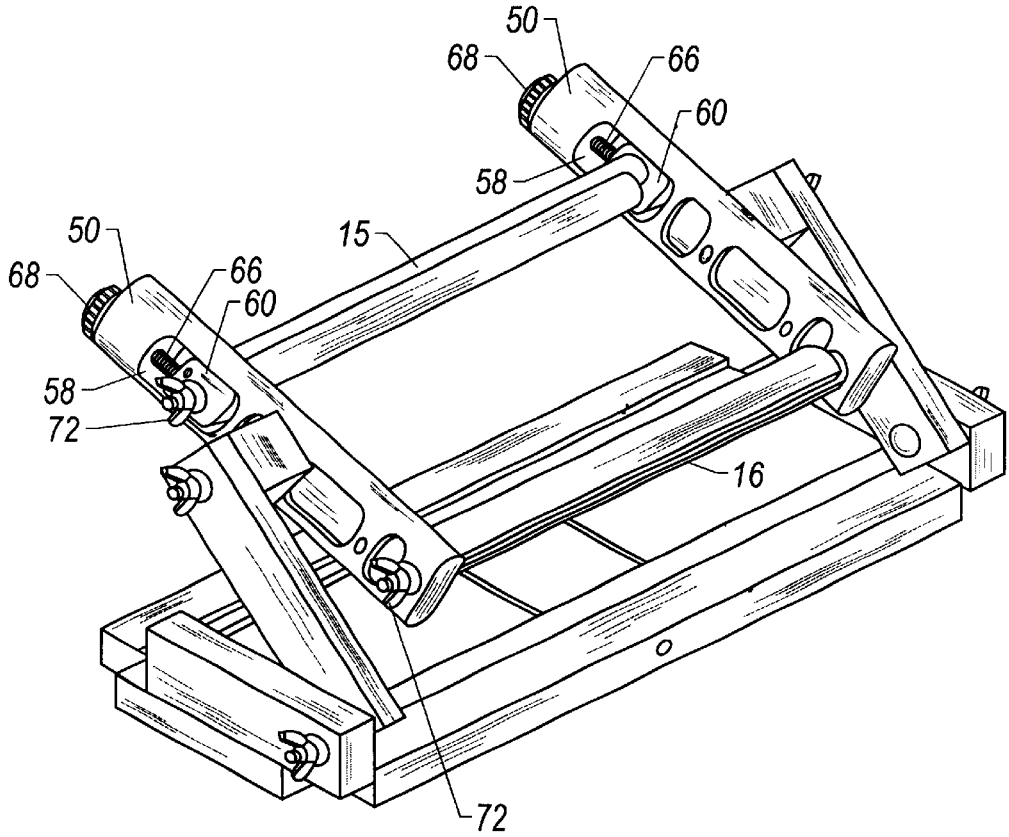
FIG. 4 is an isometric diagram of a scroll frame of the present invention attached to a base.

FIG. 4 is an isometric diagram of a scroll frame of the present invention. The scroll frame shown in FIG. 4 is similar to the prior art scroll frame shown in FIG. 1, but with the side members 12 and 13 replaced with a pair of the side members 50 shown in FIG. 3. The components of the scroll frame shown in FIG. 4 that are the same as the components shown in FIG. 1 will not be described again. A lower member 16 is coupled to the side members 50 via holes 52 and may be secured by a treaded device, such as a wing nuts 72. The lower member 16 may be secured in other ways as well. Similarly, an upper member 15 is coupled to the adjustment members 60 via holes 62 and wing nuts 72.

Figure 5:
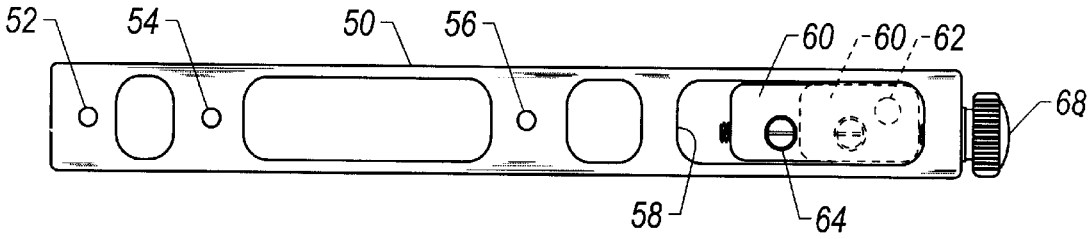
FIG. 5 is a side view of a side member of the present invention showing an adjustment member in a first position (solid lines) and a second position (dashed lines).

FIG. 5 is a side view of a side member of the present invention showing an adjustment member in a first position (solid lines) and a second position (dashed lines). The first position of the adjustment member 60 shown in FIG. 5 by solid lines, represents the position of the adjustment member 60 in a loosened position, i.e., prior to the fabric being tightened. The second position of the adjustment member 60 shown in FIG. 5 by dashed lines, represents the position of the adjustment member 60 in a tightened position, i.e., after the fabric has been tightened. Note that the positions shown in FIG. 5 are merely examples, sinse there are nearly an infinite number of possible positions achievable by adjustment of the knob 68.

Figure 6:
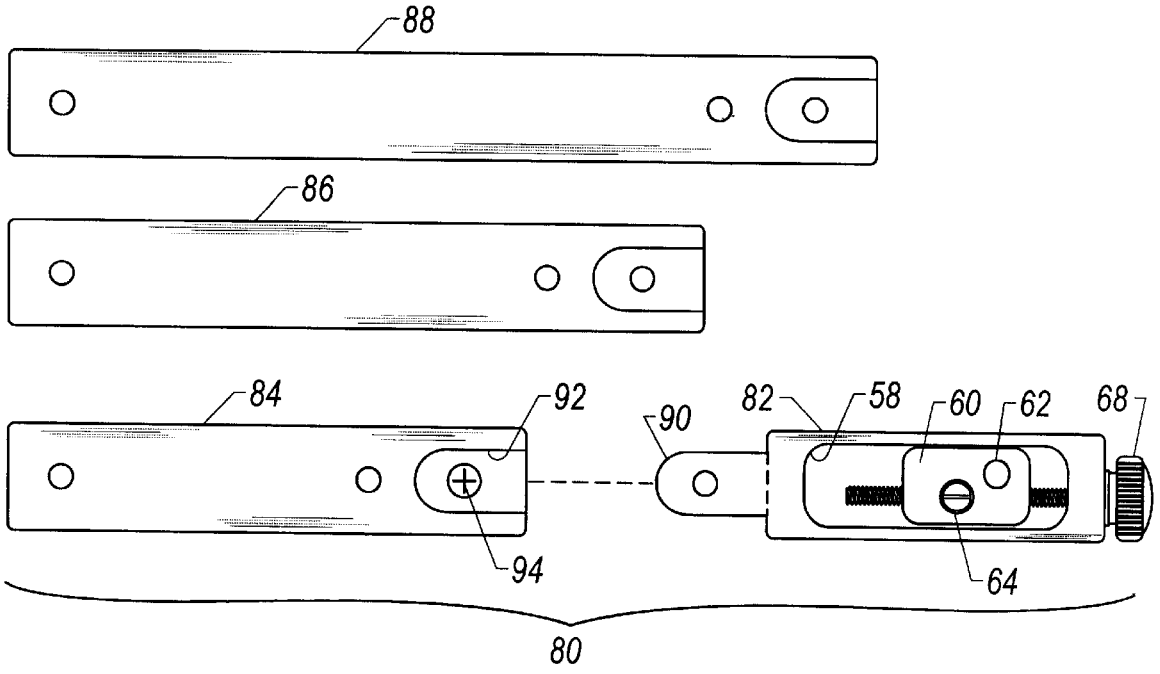
FIG. 6 is a side view of a side member assembly having a variety of possible lengths.

In another embodiment of the present invention, the side members are adjustable in length. FIG. 6 is a side view of a side member assembly having a variety of possible lengths. FIG. 6 shows a side member 80 comprised of two sub-pieces, which together form a side member similar to the side member 50 described above. Depending on the length of side member desired by a user, the user assembles a side member 80 by selecting a first sub-piece 84, 86, or 88, etc. from the available pieces. For example, to assemble a short scroll frame, the user may select the first sub-piece 84. To assemble a longer scroll frame, the user may select the first sub-piece 86 or 88. The selected first sub-piece is then attached to the second sub-piece 82 to form the side member 80. The sub-pieces are attached together by aligning a tongue 90 with a corresponding groove 92. A screw 94 can be used to secure the sub-pieces together.

Following is a description of one example of the operation of the present invention. The operation will be described in the context of a needlework scroll frame using the structure illustrated in the example shown in FIGS. 3 and 4. Once the scroll frame is assembled (FIG. 4), a user can attach a piece of fabric to the upper member 15 and the lower member 16 in a conventional manner. The user then rolls the fabric around one or both of the members 15 and/or 16 to remove most of the slack in the fabric. The upper and lower members are secured in place by tightening the four wing nuts 72. At this point, the upper lower members 15 and 16 will not turn. Once the upper and lower members are secured by the wing nuts 72, the tension of the fabric and can be easily and precisely adjusted by use of the adjustment members 60. To tighten the fabric, the adjustment knobs 68 are turned to draw the adjustment members 60 toward the end of the side members 50. Since the upper member 15 is coupled to the adjustment members 60, the upper member 15 is pulled away from the lower member 16 which tightens the fabric. To loosen the fabric, the knobs 68 are turned in the opposite direction.

If the embodiment illustrated in FIG. 6 is used, an additional step is required. Prior to assembling the scroll frame, the user will assemble side members 80 by selecting a desired length sub-piece 84, 86, or 88 to attached to the sub-piece 82. In this way, the total length of the scroll frame can be chosen by the user.

Note that the embodiments described above are merely examples and that the invention may be implemented in may differ ways within the spirit and scope of the invention. For example, the adjustment members can be moved using devices other than a screw. For example, a lever may be coupled to the adjustment member 60 such that when the lever is moved, the adjustment member is moved relative to the side member. Other examples are also possible. Similarly, although the side member 50 is shown as a mostly solid piece of material, the side member 15 may be comprised of a simple frame or other structure that still allows the invention to function as desired. The upper and lower members may be comprised of any suitable material or shape. For example, the upper and lower members may be comprised of dowels having round, or any other desired cross-section, for example, square, octagon, oval, etc. Also note that the adjustment member 60 may be coupled to the side member 50 in other ways. For example, the knob 68 may be located on the opposite side of the adjustment member 60 in an opening formed in the side member 50.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. An adjustable side member for a needlework frame comprising:

a side member having first and second ends, wherein the first end of the side member is adapted to be coupled to a first dowel;

a movable adjustment member disposed within an opening formed near the second end of the side member, the movable adjustment member being adapted to be coupled to a second dowel; and an adjustment mechanism coupled to the side member and to the movable adjustment member for adjusting the position of the movable adjustment member relative to the side member in order to adjust the distance between the first and second dowels, wherein the adjustment mechanism includes a threaded member, and wherein turning the threaded member causes the movable adjustment member to move.

2. The adjustable side member of claim 1, wherein the movable adjustment member is comprised of a block with a hole formed therethrough for receiving the second dowel.

3. The adjustable side member of claim 2, wherein the threaded member is comprised of an adjustment screw threadably coupled to the block such that the position of the block can be adjusted by turning the screw.

4. The adjustable side member of claim 3, wherein the block is disposed within the opening formed in the side member.

5. The adjustable side member of claim 1, wherein the second dowel has a round cross-section.

6. The adjustable side member of claim 5, wherein the second dowel is allowed to rotate relative to the movable adjustment member, and further comprising a nut for securing the second dowel to the movable adjustment member.

7. An adjustable needlework frame comprising:

first and second side members disposed generally parallel to each other;

a first adjustment member slideably disposed within an elongated opening formed in the first side member perpendicular to the length of the first side member;

a first threaded member coupled to the first adjustment member and the first side member, wherein turning the first threaded member causes the first adjustment member to move back and forth within the elongated opening;

a second adjustment member slideably disposed within an elongated opening formed in the second side member perpendicular to the length of the second side member;

a second threaded member coupled to the second adjustment member and the second side member, wherein turning the second threaded member causes the second adjustment member to move back and forth within the elongated opening;

a lower member coupled between the first and second side member; and an upper member coupled between the first and second adjustment members forming a substantially rectangular frame that is adjustable by turning the first and second threaded members.

8. The adjustable needlework frame of claim 7, wherein the first threaded member comprises a first screw coupled to the first adjustment member and the first side member for adjusting the position of the first adjustment member relative to the first side member.

9. The adjustable needlework frame of claim 8, wherein the second threaded member comprises a second screw coupled to the second adjustment member and the second side member for adjusting the position of the second adjustment member relative to the second side member.

10. The adjustable needlework frame of claim 7, wherein the upper member has a round cross-section.

11. The adjustable needlework frame of claim 10, wherein the upper member is rotatably coupled to the first and second adjustment members.

12. The adjustable needlework frame of claim 11, further comprising first and second nuts for securing the upper member to the first and second adjustment members.

13. The adjustable needlework frame of claim 7, wherein the first and second side members each are comprised of a first sub-piece and a second sub-piece coupled together.

14. The adjustable needlework frame of claim 13, further comprising:

a set of multiple first sub-pieces of different lengths each adapted to be coupled to a second sub-piece such that the length of the first and second side members can be adjusted by selecting desired first sub-pieces.

15. A method of maintaining a desired tension on fabric held by a frame comprising the steps of:

providing first and second side members;

providing a first adjustment member disposed within an opening formed in the first side member;

providing a first threaded member coupled to the first adjustment member and the first side member, wherein turning the first threaded member causes the first adjustment member to move back and forth within the opening;

providing a second adjustment member disposed within an opening formed in the second side member;

providing a second threaded member coupled to the second adjustment member and the second side member, wherein turning the second threaded member causes the second adjustment member to move back and forth within the opening;

providing a first dowel coupled to the first and second side members;

providing a second dowel coupled to the adjustment members and disposed at least partially within the openings formed in the first and second-side members;

attaching a piece of fabric to the first and second dowels; and adjusting the tension of the fabric by turning the first and second threaded members.

16. The method of claim 15, wherein the frame is a needlework frame.

17. The method of claim 15, wherein the frame is an art canvas frame.

18. The method of claim 15, wherein the first and second threaded members are comprised of screws, and wherein the tension of the fabric is adjusted by adjusting the screws.

19. The method of claim 15, wherein the second dowel is round.

20. The method of claim 15, wherein the first and second side members are each comprised of first and second pieces coupled to together.

21. The method of claim 20, further comprising the steps of:

providing a plurality of second pieces having different lengths; and for each side member, selectively coupling the first piece to a desired second piece to provide a side member having a desired length.

22. An adjustable needlework frame comprising:

first and second side members disposed generally parallel to each other;

a first adjustment member slideably disposed within an elongated opening formed in the first side member perpendicular to the length of the first side member;

a second adjustment member slideably disposed within an elongated opening formed in the second side member perpendicular to the length of the second side member;

a lower member coupled between the first and second side member;

an upper member having a round cross-section rotatably coupled between the first and second adjustment members forming a substantially rectangular frame that is adjustable by moving the first and second adjustment members back and forth within the elongated openings; and first and second nuts for securing the upper member to the first and second adjustment members.

23. The adjustable needlework frame of claim 22 further comprising a first screw coupled to the first adjustment member and the first side member for adjusting the position of the first adjustment member relative to the first side member.

24. The adjustable needlework frame of claim 23, further comprising a second screw coupled to the second adjustment member and the second side member for adjusting the position of the second adjustment member relative to the second side member.

25. An adjustable needlework frame comprising:

first and second side members disposed generally parallel to each other, wherein the first and second side members each are comprised of a first sub-piece and a second sub-piece coupled together;

a first adjustment member slideably disposed within an elongated opening formed in the first side member perpendicular to the length of the first side member;

a second adjustment member slideably disposed within an elongated opening formed in the second side member perpendicular to the length of the second side member;

a lower member coupled between the first and second side member; and an upper member coupled between the first and second adjustment members forming a substantially rectangular frame that is adjustable by moving the first and second adjustment members back and forth within the elongated openings.

26. The adjustable needlework frame of claim 25, further comprising:

a set of multiple first sub-pieces of different lengths each adapted to be coupled to a second sub-piece such that the length of the first and second side members can be adjusted by selecting desired first sub-pieces.

27. A method of maintaining a desired tension on fabric held by a frame comprising the steps of:

providing first and second side members, wherein the first and second side members are each comprised of first and second pieces coupled to together;

providing a first adjustment member disposed within an opening formed in the first side member;

providing a second adjustment member disposed within an opening formed in the second side member;

providing a first dowel coupled to the first and second side members;

providing a second dowel coupled to the adjustment members and disposed at least partially within the openings formed in the first and second side members;

attaching a piece of fabric to the first and second dowels; and adjusting the tension of the fabric by moving the first and second adjustment members relative to the first and second side members.

28. The method of claim 27, further comprising the steps of:

providing a plurality of second pieces having different lengths; and for each side member, selectively coupling the first piece to a desired second piece to provide a side member having a desired length.

29. The method of claim 27, wherein the tension of the fabric is adjusted by adjusting screws coupled between the adjustment members and the side members.

30. The adjustable side member of claim 1, wherein the side member is comprised of a first sub-piece and a second sub-piece coupled together.

31. The adjustable side member of claim 30, further comprising:

a set of multiple first sub-pieces of different lengths each adapted to be coupled to the second sub-piece such that the length of the side member can be adjusted by selecting a desired first sub-piece.

* * * * *